US005898361A

United States Patent [19]

Park

[11] Patent Number: 5,898,361

[45] Date of Patent: Apr. 27, 1999

[54] SERIAL DATA COMMUNICATION DEVICE OF AIR CONDITIONER

[75] Inventor: Gwi Guen Park, Kyungsangnam-do, Rep. of Korea

[73] Assignee: LG Electronics Inc., Rep. of Korea

[21] Appl. No.: 08/917,412

[22] Filed: Aug. 25, 1997

[30] Foreign Application Priority Data

Aug. 27, 1996 [KR] Rep. of Korea ..... 96-35691

[51] Int. Cl.[6] ..... H04M 11/04

[52] U.S. Cl. ..... 340/310.01; 340/310.06; 340/538; 395/200.57

[58] Field of Search ..... 340/310.01, 310.06, 340/501, 531, 533, 538; 395/200.57, 200.68, 200.69; 62/81, 129, 156, 160, 193, 228.4, 222

[56] References Cited

U.S. PATENT DOCUMENTS 5,528,760 6/1996 Nam ..... 395/200.14
5,528,908 6/1996 Bahel et al. ..... 62/81

*Primary Examiner*—Jeffery A. Hofsass
*Assistant Examiner*—Daryl C. Pope
*Attorney, Agent, or Firm*—Anthony J. Casella; Gerald E. Hespos; Ludomir A. Bodzyn

[57] ABSTRACT

A serial data communication device of an air conditioner including: an outdoor microprocessor having data transmitting/receiving terminals which transmit/receive a predetermined data; an indoor microprocessor having data transmitting/receiving terminals which transmit/receive data to/from the outdoor microprocessor; a rectification part for converting an alternating current power to a predetermined level of a direct current power to thereby supply the direct current power to the indoor/outdoor microprocessors; an outdoor interface part connected between the data transmitting terminal of the outdoor microprocessor and a direct power output terminal of the rectification part, for isolating the rectification part and the outdoor microprocessor through a first insulation switching part and simultaneously for constituting a first communication line; and an indoor interface part for isolating the rectification part and the indoor microprocessor through a second insulation switching part and simultaneously for constituting a second communication line.

7 Claims, 5 Drawing Sheets

SERIAL DATA COMMUNICATION DEVICE OF AIR CONDITIONER

BACKGROUND OF THE INVENTION

1. Field of the Invention

The present invention relates to an air conditioner, and more particularly, to a serial data communication device of an air conditioner which is capable of executing a serial data communication by using an alternating current power line between an indoor microprocessor and an outdoor microprocessor.

2. Discussion of Related Art

Generally, an air conditioner is comprised of an indoor heat exchanger and an outdoor heat exchanger. In the air conditioner, typically, an indoor device is occupied on the interior of space in which air conditioning and dehumidification are needed and an outdoor device is occupied on the outside of the above space. For example, in case of house or building, the area in which the air conditioner is to be installed is firstly divided into an indoor area in which a human body dwells and an outdoor area.

Such the air conditioner includes a compressor which serves to compress refrigerant, an outdoor heat exchange which expands the refrigerant within a passage, a capillary tube which functions to reduce the pressure of refrigerant within the compressor, and an indoor heat exchanger to which an indoor fan is attached, each of which is connected by a pipe line.

FIG. 1 is a circuit diagram illustrating a serial data communication device of an air conditioner in the prior art. Referring to FIG. 1, the conventional communication device connects an indoor microprocessor 50 with an outdoor microprocessor 10 by means of a connector CNT1, thus to achieve the communication between the indoor/outdoor microprocessors and to accomplish the supply of an alternating current power to the outdoor microprocessor 10.

In more detail, terminals C and D of the connector CNT1 serve to supply the alternating current power to the outdoor microprocessor 10, and terminals A and B of the connector CNT1 forms a communication line between the indoor microprocessor 50 and the outdoor microprocessor 10, to thereby achieve a serial data communication therebetween.

A data transmission process from the indoor microprocessor 50 to the outdoor microprocessor 10 will be firstly discussed.

In the case where data transmission of the indoor microprocessor 50 to the outdoor microprocessor 10 is performed, a data receiving terminal RXD1 of the indoor microprocessor 50 is in a disabled state, and then a data transmitting terminal TXD1 of the indoor microprocessor 50 outputs the data to be transmitted to the outdoor microprocessor 10.

Next, a first comparator COMP1 compares an output voltage waveform with a reference voltage waveform which is adjusted by resistors R2 and R3, to thereby output the compared result to the terminal A of the connector CNT1 through an output resistor R9 and a pull-up resistor R10.

Then, the transmission data on the data transmitting terminal TXD1 of the indoor microprocessor 50 is transmitted through a first photocoupler PC1. Thereafter, the transmission data is passed through a pull-up resistor R12 and a load resistor R13, to prevent the generation of noise therein, and is then transmitted to a data receiving terminal RXD2 of the outdoor microprocessor 10.

Secondly, in the case where data transmission of the outdoor microprocessor 10 to the indoor microprocessor 50 is performed, the data receiving terminal RXD2 of the outdoor microprocessor 10 is in a disabled state, and then a data transmitting terminal TXD2 of the outdoor microprocessor 10 outputs the data to be transmitted to the indoor microprocessor 50. Then, the data outputted from the data transmitting terminal TXD2 is transmitted through a second photocoupler PC2 and is finally applied to an input terminal of a second comparator COMP2 through resistors R14, R9 and R7 and a pull-up resistor R10.

Next, the second comparator COMP2 compares the output voltage level of the data transmitted from the outdoor microprocessor 10 with the reference voltage level to thereby output the compared result to the data receiving terminal RXD1 of the indoor microprocessor 50, thus to achieve a desired data communication between the indoor microprocessor 50 and the outdoor microprocessor 10.

A reference numeral R4 denotes a load resistor, R5 a pull-up resistor, each of R5 and R8 a divisional pressure resistor, and R16 a protection resistor of a light emitting diode LED1. Further, each of reference numerals C1, C2 and C3 represents a noise removing condenser.

However, the conventional serial data communication device in an air conditioner should require two power lines for supplying an alternating current power and two communication lines for exchanging data, such that there is a problem in that the disconnection between the alternating current power lines and the communication lines may be generated, which results in the damage of peripheral circuits thereof, unfortunately.

Moreover, the conventional serial data communication device in an air conditioner should have a single connector in which the alternating power lines and the communication lines are all formed, such that there is a problem in that noises in data during the data transmission may be generated.

SUMMARY OF THE INVENTION

Accordingly, the present invention is directed to a serial data communication device of an air conditioner that substantially obviates one or more of the problems due to limitations and disadvantages of the related art.

An object of the invention is to provide a serial data communication device of an air conditioner which can form a communication line by using alternating current power lines, thus to decrease the number of communication lines between an indoor microprocessor and an outdoor microprocessor and at the same time to prevent peripheral circuits from being damaged due to the disconnection of the lines.

To accomplish this and other objects of the present invention, a serial data communication device of an air conditioner includes: an outdoor microprocessor having first data transmitting/receiving terminals which transmit/receive a predetermined data; an indoor microprocessor having second data transmitting/receiving terminals which transmit/receive data to/from the outdoor microprocessor; a rectification part for converting an alternating current power to a predetermined level of a direct current power to thereby supply the direct current power to the indoor/outdoor microprocessors; an outdoor interface part connected between the data transmitting terminal of the outdoor microprocessor and a direct power output terminal of the rectification part and for isolating the rectification part and the outdoor microprocessor through a first insulation switching part and simultaneously for constituting a first communication line; and an indoor interface part for isolating the rectification part and the indoor microprocessor through a second insulation switching part and simultaneously for constituting a second communication line.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

Figure 5:
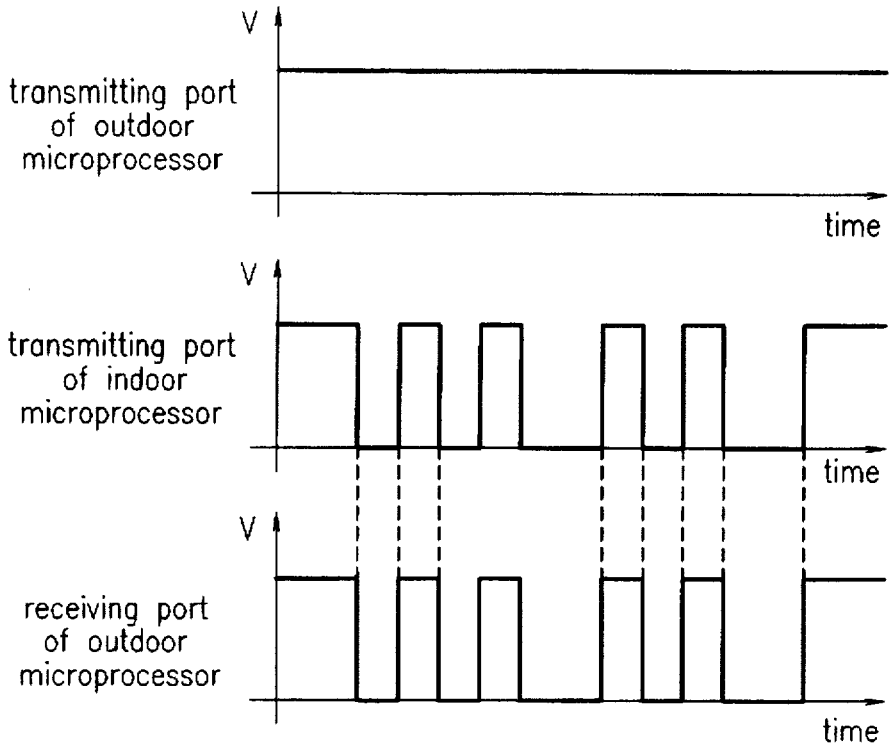
Figure 6:
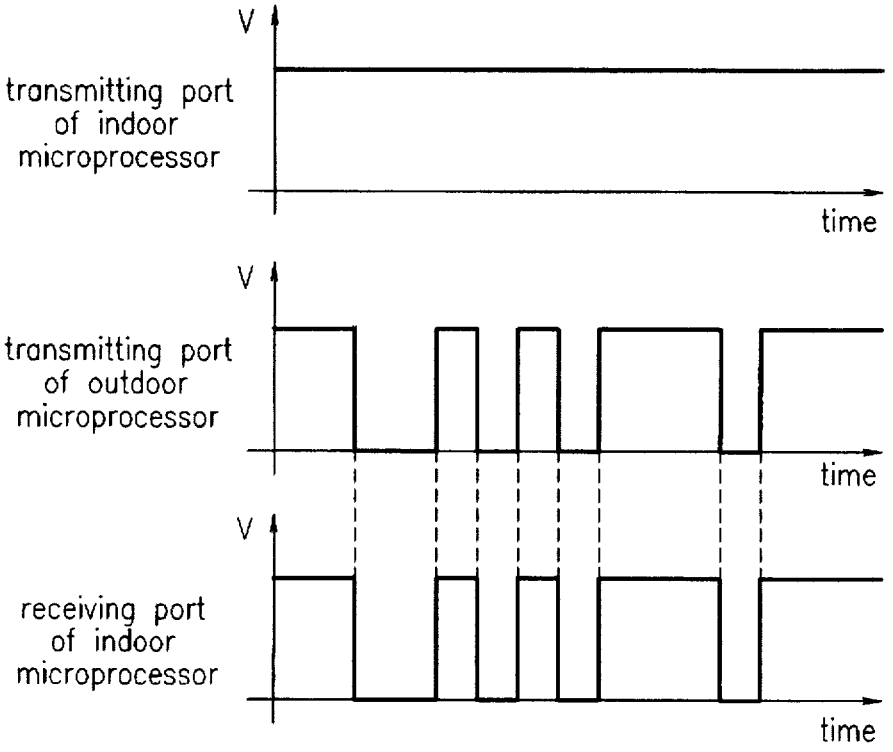

FIG. 5 is a waveform diagram illustrating transmission signals of each parts during data transmission of an indoor microprocessor to an outdoor microprocessor is executed, using the serial data communication device constructed according to the present invention; and FIG. 6 is a waveform diagram illustrating transmission signals of each parts during data transmission of an outdoor microprocessor to an indoor microprocessor is executed, using the serial data communication device constructed according to the present invention.

DETAILED DESCRIPTION OF PREFERRED EMBODIMENT

Reference will now be made in detail to the preferred embodiments of the present invention, examples of which are illustrated in the accompanying drawings.

Now, the construction of a serial data communication device of an air conditioner according to a preferred embodiment of the present invention will be discussed with reference to FIGS. 2 and 3.

Figure 1:
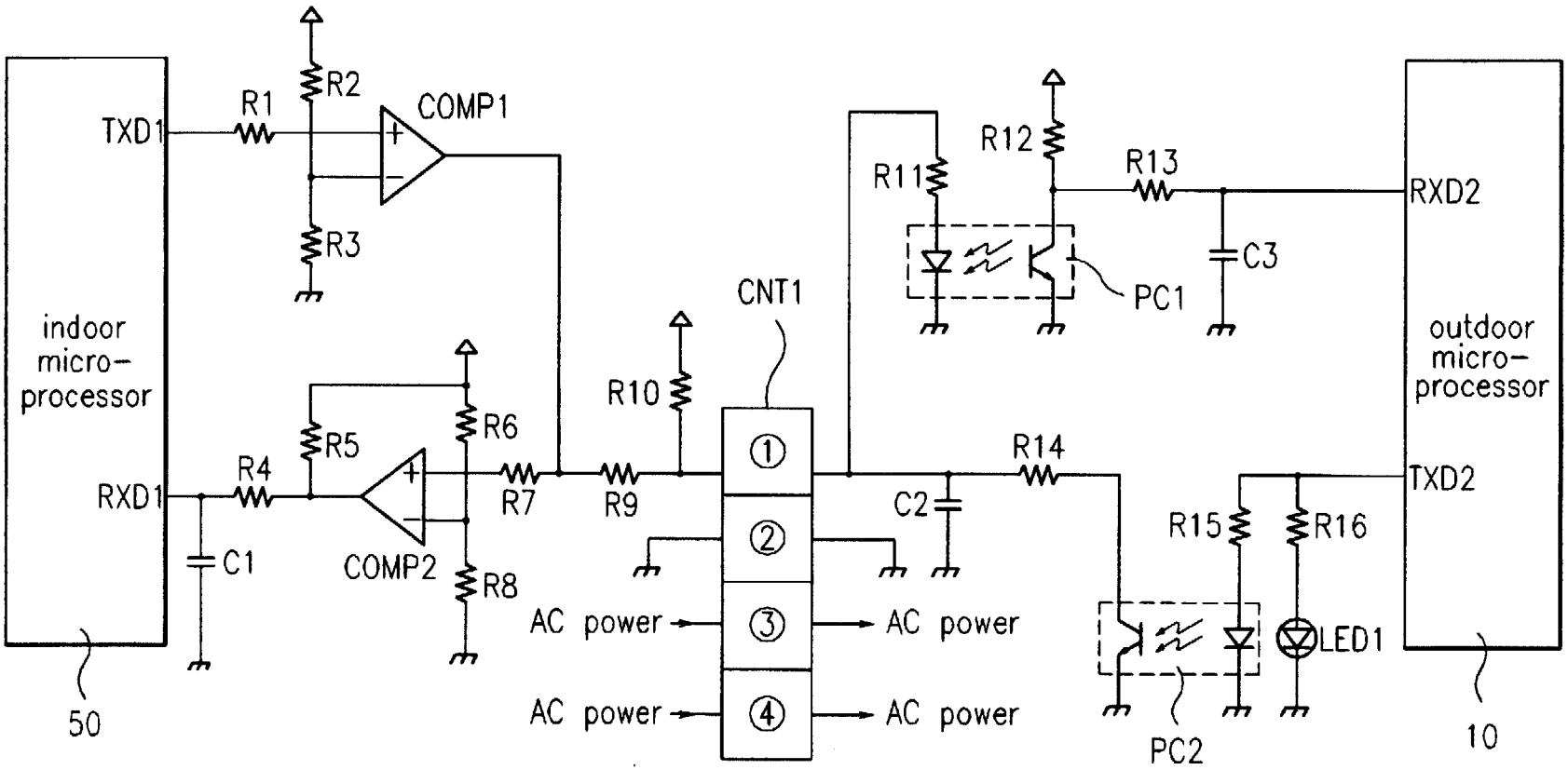
FIG.1 prior art
FIG. 1 is a circuit diagram illustrating a serial data communication device of an air conditioner in the prior art.
Figure 2:
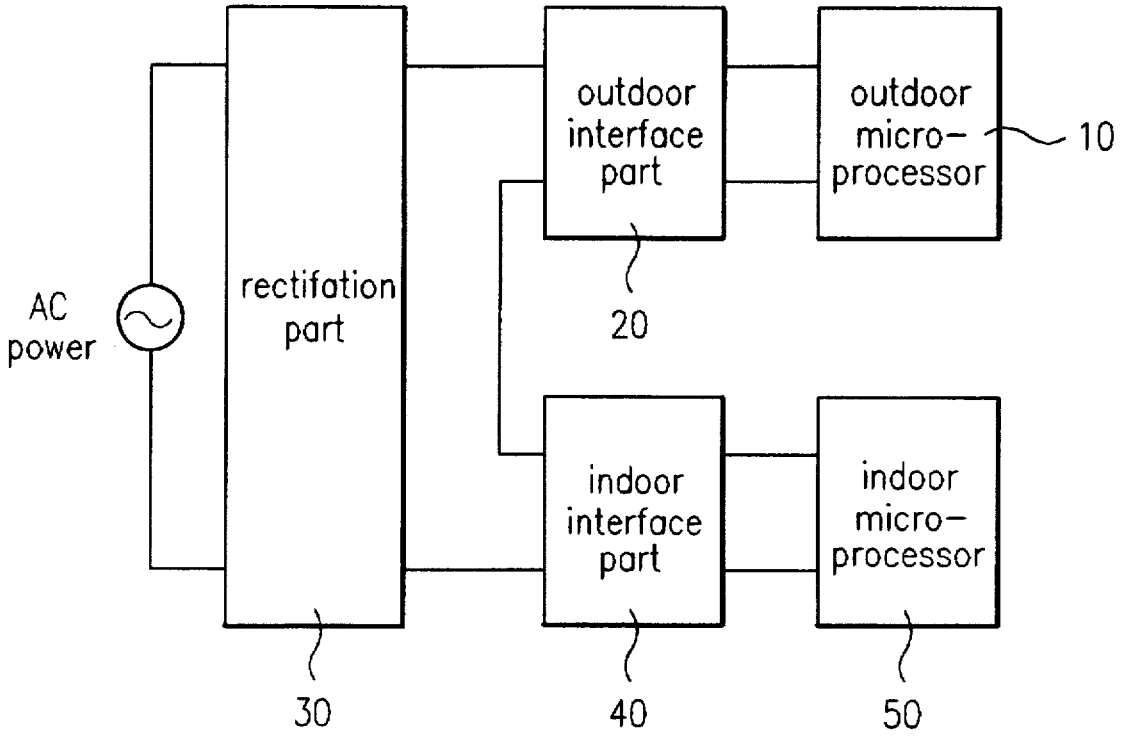
FIG. 2 is a block diagram illustrating a serial data communication device of an air conditioner constructed according to the present invention.
Figure 3:
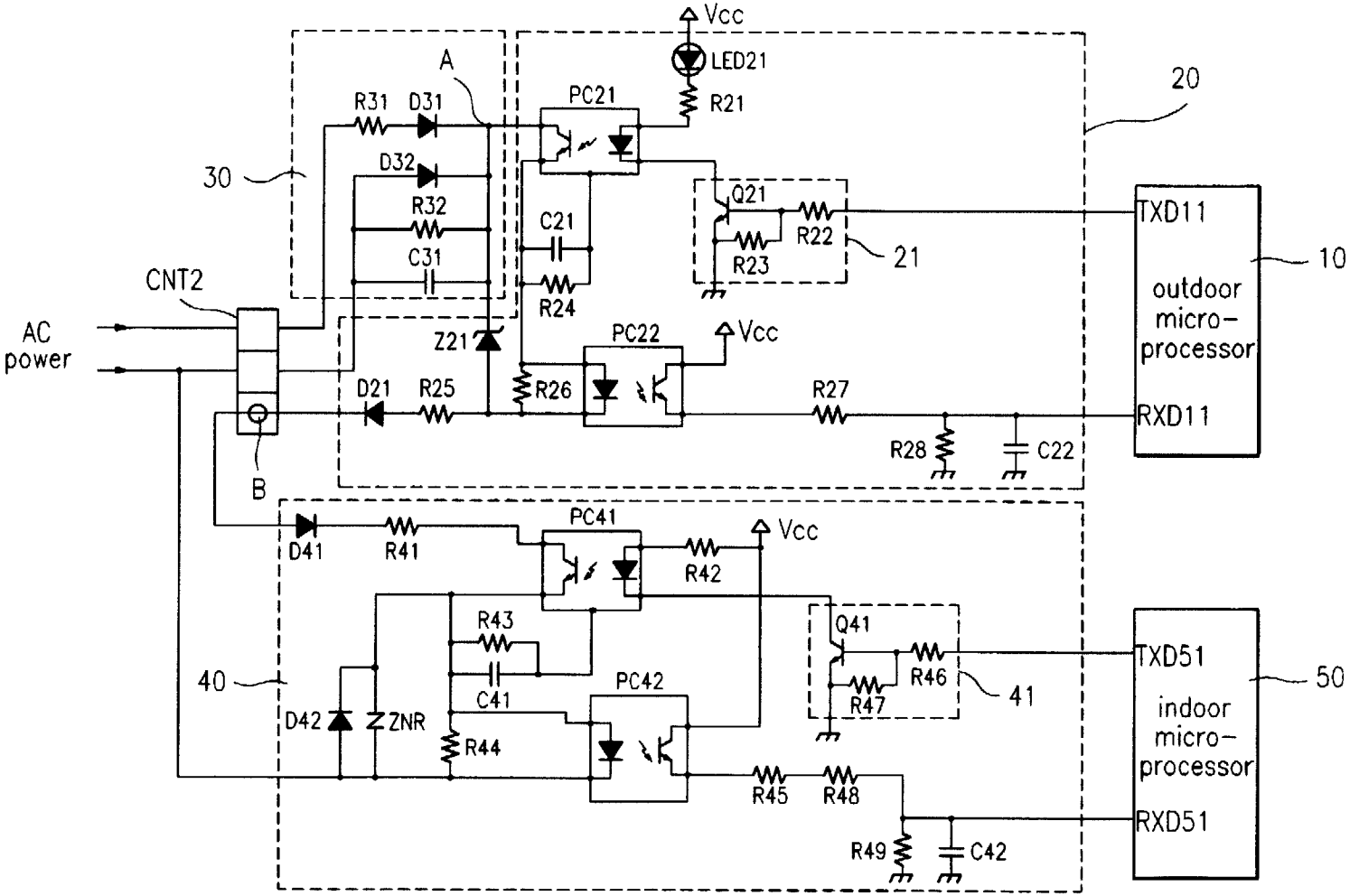
FIG. 3 is a detailed circuit diagram of FIG. 2.

FIG. 2 is a block diagram illustrating a serial data communication device of an air conditioner according to the present invention, and FIG. 3 is a detailed circuit diagram of FIG. 2. In construction, the serial data communication device includes: an outdoor microprocessor 10 having data transmitting/receiving terminals TXD11 and RXD11 which transmit/receive a predetermined data; an indoor microprocessor 50 having data transmitting/receiving terminals TXD51 and RXD51 which transmit/receive data to/from the outdoor microprocessor 10; a rectification part 30 for converting an alternating current power to a predetermined level of a direct current power to thereby supply the direct current power to the indoor/outdoor microprocessors 50 and 10; an outdoor interface part 20 connected between the data transmitting terminal TXD11 of the outdoor microprocessor 10 and a direct power output terminal of the rectification part 30, for isolating the rectification part 30 and the outdoor microprocessor 10 through a first insulation switching part PC21 and simultaneously for constituting a first communication line; and an indoor interface part 40 for isolating the rectification part 30 and the indoor microprocessor 50 through a second insulation switching part PC22 and simultaneously for constituting a second communication line.

The outdoor interface part 20 is connected between the data transmitting terminal TXD11 of the outdoor microprocessor 10 and the output terminal of the rectification part 30, and is comprised of: a first switching part 21 which is turned on/off according to an output signal of the data transmitting terminal TXD11, to thereby transmit the data; the first insulation switching part PC21 which is turned on/off according to a switching operation of the first switching part 21, thus to transmit the data as the direct current power outputted from the rectification part 30 is interrupted and at the same time, to insulate the rectification part 30 and the data transmitting terminal TXD11 of the outdoor microprocessor 10; and the second insulation switching part PC22 which is connected between the first insulation switching part PC21 and the data receiving terminal RXD11 of the outdoor microprocessor 10 and is turned on/off according to the switching operation of the first switching part 21, thus to transmit the data as the direct current power outputted from the rectification part 30 is interrupted and at the same time, to insulate the rectification part 30 and the data receiving terminal RXD11 of the outdoor microprocessor 10.

The first switching part 21 is preferably comprised of a first switching transistor Q21 and a plurality of resistors R22 and R23 which are each connected in parallel with the base and collector terminals of the switching transistor Q21. Further, it is preferable that each of the first insulation switching part PC21 and the second insulation switching part PC22 be comprised of a photocoupler.

The indoor interface part 40 is connected between the data transmitting terminal TXD51 of the indoor microprocessor 50 and a connector CNT2, and is comprised of: a second switching part 41 which is turned on/off according to an output signal of the data transmitting terminal TXD51, to thereby transmit the data; a third insulation switching part PC41 which is turned on/off according to the switching operation of the second switching part 41, thus to transmit the data as the direct current power outputted from the rectification part 30 is interrupted and at the same time, to insulate the rectification part 30 and the data transmitting terminal TXD51 of the indoor microprocessor 50; and a fourth insulation switching part PC42 which is connected between the third insulation switching part PC41 and the data receiving terminal RXD51 of the indoor microprocessor 50 and is turned on/off according to the switching operation of the third insulation switching part PC41, thus to transmit the data as the direct current power outputted from the rectification part 30 is interrupted and at the same time, to insulate the rectification part 30 and the data receiving terminal RXD51 of the indoor microprocessor 50.

The second switching part 41 is preferably comprised of a second switching transistor Q41 and a plurality of resistors R46 and R47 which are each connected in parallel with the base and collector terminals of the switching transistor Q41. Further, it is preferable that each of the third insulation switching part PC41 and the fourth insulation switching part PC42 be comprised of a photocoupler.

(Embodiment)

As shown in FIG. 3, the rectification part 30 is comprised of first and second rectifying diodes D31 and D32, a smoothing condenser C31 and a resistor R32, which are connected in parallel with two lines of the connector CNT2. A reference numeral R31 represents an overvoltage protecting resistor.

The base terminal of the first switching transistor Q21 is connected to the data transmitting terminal TXD11 of the outdoor microprocessor 10. A photodiode of the first insulation switching part PC21 is connected between a power supply voltage Vcc terminal and the collector terminal of the first switching transistor Q21, and a phototransistor thereof is connected to the output terminal of the rectification part 30.

A phototransistor of the second insulation switching part PC22 is connected between the data receiving terminal RXD11 of the outdoor microprocessor 10 and a power supply voltage Vcc terminal, and a photodiode thereof is connected to the output terminal of the rectification part 30.

Each of reference numerals R22 and R27 denote a load resistor, R28 a ground resistor, each of R21 and R26 a protecting resistor, each of R24 and C21 a filter, C22 a noise removing condenser, Z21 a zener diode, and D21 a reverse current preventing diode.

The base terminal of the second switching transistor Q41 is connected to the data transmitting terminal TXD51 of the indoor microprocessor 50. Then, a photodiode of the third insulation switching part PC41 is connected between a power supply voltage Vcc terminal and the collector terminal of the second switching transistor Q41, and a phototransistor thereof is connected to the output terminal of the outdoor interface unit 20 through a reverse current preventing diode D41 and a protection resistor R41.

A phototransistor of the fourth insulation switching part PC42 is connected between the data receiving terminal RXD51 of the indoor microprocessor 50 and a power supply voltage Vcc terminal, and a photodiode thereof is connected in parallel to the output terminal of the phototransistor of the third insulation switching part PC41.

Each of reference numerals R46, R45 and R48 denote a load resistor, R49 a ground resistor, each of R42 and R44 a protection resistor, each of R43 and C41 a filter, C42 a noise removing condenser, and each of ZNR and D42 elements for protecting circuits from an overvoltage or a reverse electromotive force.

Now, an explanation of operation and effects of a serial data communication device of an air conditioner according to the present invention will be discussed hereinafter.

First, if the air conditioner is operated, the rectification part 30 converts the alternating current power into the direct current power, and a signal of a logic "high" level is outputted to the data transmitting terminals TXD11 and TXD51 of the outdoor microprocessor 10 and the indoor microprocessor 50, respectively, to thereby enable the first and second switching transistors Q21 and Q41 and to thereby enable the photodiodes of the first and third insulation switching parts PC21 and PC41. At the same time, the data receiving terminals RXD11 and RXD51 of the outdoor microprocessor 10 and the indoor microprocessor 50 are in an enabled state, to thereby be in a standby state for reception of the data.

Meanwhile, if the outdoor microprocessor 10 receives the data in the state where the receiving terminals RXD11 and RXD51 are in the standby state, the data is passed in order of the resistor R22, the first switching transistor Q21, the first insulation switching part PC21, the second insulation switching part PC22, the resistor R25, the diode D21, the connector CNT2, the diode D41, the resistor R41, the third insulation switching part PC41, the fourth insulation switching part PC42, and the resistors R45 and R48 and is finally transmitted to the data receiving terminal RXD51 of the indoor microcomputer 50.

Figure 4A:
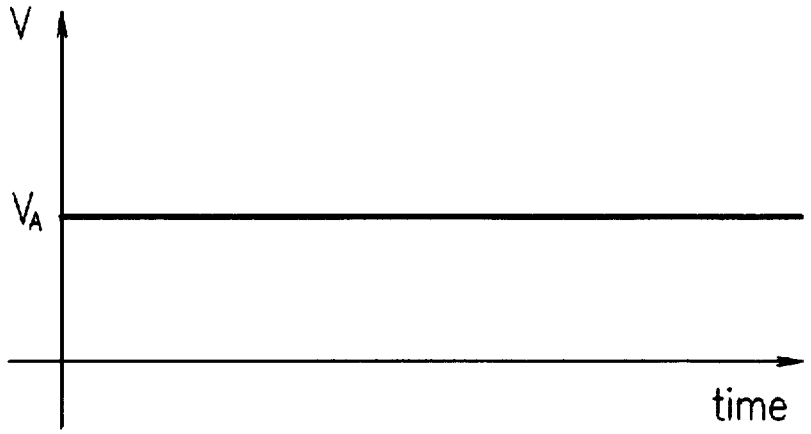
FIGS. 4A and 4B are waveform diagrams illustrating output voltages on nodes A and B of FIG. 3.
Figure 4B:
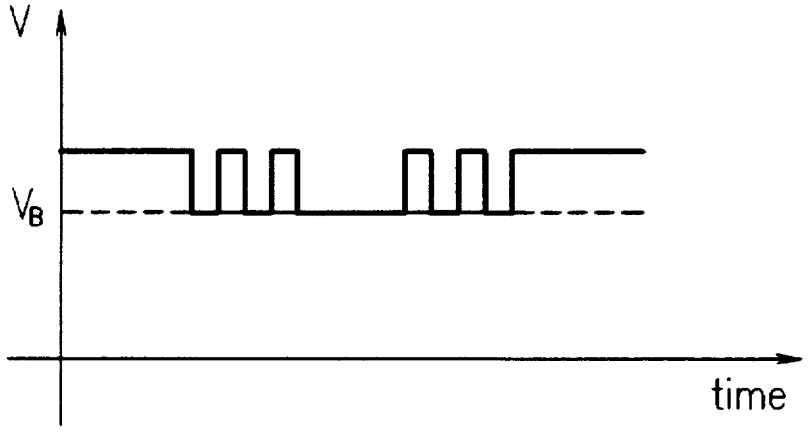

FIGS. 4A and 4B are waveform diagrams illustrating output voltages on nodes A and B of FIG. 3. FIG. 5 is a waveform diagram illustrating transmission signals of each parts, during data transmission of the indoor microprocessor 50 to the outdoor microprocessor 10 is executed.

In the case where data transmission of the indoor microprocessor 50 to the outdoor microprocessor 10 is executed, the second switching transistor Q41 and the third insulation switching part PC41 are turned on/off in accordance with the control signal outputted from the data transmitting terminal TXD51. As a result, the second insulation switching part PC22 is turned on/off, to thereby transmit the data to the data receiving terminal RXD11 of the outdoor microprocessor 10 through the resistor R27.

In other words, since the data transmitting terminal TXD11 of the outdoor microprocessor 10 is in a logic "high" state, the first switching transistor Q21 and the first insulation switching part PC21 are enabled. As a result, the power is applied through the second insulation switching part PC22 to the third insulation switching part PC41. The second insulation switching part PC22 is turned on/off as the third insulation switching part PC41 is turned on/off, such that the data is finally transmitted to the data receiving terminal RXD11 of the outdoor microprocessor 10.

FIG. 6 is a waveform diagram illustrating transmission signals of each parts, during data transmission of the outdoor microprocessor 10 to the indoor microprocessor 50 is executed.

Hence, it can be appreciated in the serial data communication device of an air conditioner according to the present invention that two lines for supplying the alternating current power and a single line for transmitting the data are required, for the purpose of achieving the power supply and data transmission/reception.

As clearly apparent from the foregoing, a serial data communication device of an air conditioner according to the present invention has the following advantages: since a communication line is formed by using alternating power lines, the number of communication lines between an indoor microprocessor and an outdoor microprocessor can be reduced and the generation of noises in data during the data transmission can be prevented. Furthermore, a serial data communication device of an air conditioner according to the present invention can previously avoid the disconnection of the communication line, to thereby prevent the peripheral circuits from being damaged due to the disconnection thereof.

It will be apparent to those skilled in the art that various modifications and variations can be made in a serial data communication device of an air conditioner of the present invention without departing from the spirit or scope of the invention. Thus, it is intended that the present invention cover the modifications and variations of this invention provided they come within the scope of the appended claims and their equivalents.

What is claimed is:

1. A serial data communication device of an air conditioner, comprising:

an outdoor microprocessor having first data transmitting/receiving terminals which transmit/receive a predetermined data;

an indoor microprocessor having second data transmitting/receiving terminals which transmit/receive the data to/from said outdoor microprocessor;

a rectification part for converting an alternating current power to a predetermined level of a direct current power to thereby supply the direct current power to said indoor/outdoor microprocessors;

an outdoor interface part connected between said first data transmitting terminal of said outdoor microprocessor and a direct power output terminal of said rectification part, for isolating said rectification part and said outdoor microprocessor through a first insulation switching part and simultaneously for constituting a first communication line; and an indoor interface part for isolating said rectification part and said indoor microprocessor through a second insulation switching part and simultaneously for constituting a second communication line.

2. The device as defined in claim 1, wherein said outdoor interface part is connected between said first data transmitting terminal of said outdoor microprocessor and the output terminal of said rectification part and is comprised of: a first switching part which is turned on/off according to an output signal of said first data transmitting terminal, to thereby transmit the data; said first insulation switching part which is turned on/off according to a switching operation of said first switching part, thus to transmit the data as the direct current power outputted from said rectification part is interrupted and at the same time, to insulate said rectification part and said first data transmitting terminal of said outdoor microprocessor; and said second insulation switching part which is connected between said first insulation switching part and said first data receiving terminal of said outdoor microprocessor and is turned on/off according to the switching operation of said first switching part, thus to transmit the data as the direct current power outputted from said rectification part is interrupted and at the same time, to insulate said rectification part and said first data receiving terminal of said outdoor microprocessor.

3. The device as defined in claim 2, wherein said first switching part is comprised of a first switching transistor and a plurality of resistors which are each connected in parallel with base and collector terminals of said first switching transistor.

4. The device as defined in claim 2, wherein each of said first insulation switching part and said second insulation switching part is comprised of a photocoupler.

5. The device as defined in claim 1, wherein said indoor interface part is connected between said second data transmitting terminal of said indoor microprocessor and a connector and is comprised of: a second switching part which is turned on/off according to an output signal of said second data transmitting terminal, to thereby transmit the data; a third insulation switching part which is turned on/off according to a switching operation of said second switching part, thus to transmit the data as the direct current power outputted from said rectification part is interrupted and at the same time, to insulate said rectification part and said second data transmitting terminal of said indoor microprocessor; and a fourth insulation switching part which is connected between said third insulation switching part and said second data receiving terminal of said indoor microprocessor and is turned on/off according to the switching operation of said third insulation switching part, thus to transmit the data as the direct current power outputted from said rectification part is interrupted and at the same time, to insulate said rectification part and said second data receiving terminal of said indoor microprocessor.

6. The device as defined in claim 5, wherein said second switching part is comprised of a second switching transistor and a plurality of resistors which are each connected in parallel with base and collector terminals of said second switching transistor.

7. The device as defined in claim 5, wherein each of said third insulation switching part and said fourth insulation switching part is comprised of a photocoupler.

* * * * *